US008905360B2

(12) United States Patent
Xu et al.

(10) Patent No.: US 8,905,360 B2
(45) Date of Patent: Dec. 9, 2014

(54) TRAIN SIGNALING SYSTEM AND METHOD FOR DETECTING DISTANCE-TO-GO OF A TRAIN

(71) Applicant: ITSR (Hong Kong) Limited, Hong Kong (HK)

(72) Inventors: Fei Xu, Hong Kong (HK); Sun Hoi Wong, Hong Kong (HK)

(73) Assignee: ITSR (Hong Kong) Limited, Hong Kong (HK)

( * ) Notice: Subject to any disclaimer, the term of this patent is extended or adjusted under 35 U.S.C. 154(b) by 0 days.

(21) Appl. No.: 14/073,867

(22) Filed: Nov. 7, 2013

(65) Prior Publication Data

US 2014/0054424 A1 Feb. 27, 2014

Related U.S. Application Data

(63) Continuation of application No. PCT/CN2012/081193, filed on Sep. 10, 2012.

(30) Foreign Application Priority Data

Sep. 15, 2011 (CN) ..... 2011 1 0273999

(51) Int. Cl.

| | |
|---|---|
| ***B61L 23/34*** | (2006.01) |
| ***B61L 25/02*** | (2006.01) |
| ***B61L 23/18*** | (2006.01) |
| ***B61L 27/00*** | (2006.01) |
| ***B61L 3/00*** | (2006.01) |

(52) U.S. Cl.

CPC ..... *B61L 25/026* (2013.01); *B61L 23/18* (2013.01); *B61L 23/34* (2013.01); *B61L 27/0038* (2013.01); *B61L 3/008* (2013.01); *B61L 2027/005* (2013.01)

USPC ..... 246/122 R; 701/19

(58) Field of Classification Search

USPC ..... 246/122 R, 123, 124, 125, 144, 167 R, 246/473 R; 701/19

See application file for complete search history.

(56) References Cited

U.S. PATENT DOCUMENTS

| | | | | |
|---|---|---|---|---|
| 2,133,627 | A * | 10/1938 | McCann et al. | 246/134 |
| 3,250,914 | A * | 5/1966 | Reich | 246/5 |
| 5,029,294 | A * | 7/1991 | Kim | 340/988 |
| 7,027,901 | B2 * | 4/2006 | Oguma et al. | 701/19 |

(Continued)

FOREIGN PATENT DOCUMENTS

CN 101393686 A 3/2009

OTHER PUBLICATIONS

International Search Report of PCT Application No. PCT/CN2012/081193.

*Primary Examiner* — Jason C Smith

(57) ABSTRACT

A train signaling system, including a traffic signaling chain terminus set up unit configured to set a terminus location of a train running on the track and transmit a wireless traffic signal, a plurality of traffic signaling chain relay units installed along the track and configured to forward the wireless traffic signal and allow the wireless traffic signal to form a traffic signaling chain comprising distance-to-go information of the train, and a traffic signaling chain detection unit configured to allow the train to achieve the receipt of the information on the traffic signaling chain and calculate the distance-to-go of the train. A method for detecting distance-to-go of a train is also provided.

17 Claims, 6 Drawing Sheets

(56) References Cited

U.S. PATENT DOCUMENTS

| | | | | |
|---|---|---|---|---|
| 7,200,470 | B2 * | 4/2007 | Oguma et al. | 701/19 |
| 7,495,579 | B2 * | 2/2009 | Sirota et al. | 340/907 |
| 8,073,581 | B2 * | 12/2011 | Morris et al. | 701/19 |
| 8,244,456 | B2 * | 8/2012 | Morris | 701/300 |
| 2006/0119489 | A1 * | 6/2006 | Shinada et al. | 340/901 |
| 2006/0155433 | A1 * | 7/2006 | Oguma et al. | 701/19 |
| 2012/0217350 | A1 * | 8/2012 | Ghaly | 246/27 |
| 2014/0054424 | A1 * | 2/2014 | Xu et al. | 246/122 R |

* cited by examiner

TRAIN SIGNALING SYSTEM AND METHOD FOR DETECTING DISTANCE-TO-GO OF A TRAIN

CROSS-REFERENCE TO RELATED APPLICATIONS

The present application is a Continuation Application of PCT application No. PCT/CN2012/081193 filed on Sep. 10, 2012, which claims the benefit of Chinese Patent Application No. 201110273999.3 filed on Sep. 15, 2011; the contents of which are hereby incorporated by reference.

FIELD OF THE TECHNOLOGY

The present application relates generally to a signaling system, and particularly to a train signaling system. The present application also relates to a method for detecting the distance-to-go of a train.

BACKGROUND

Under the current railway traffic condition, a "block system" is basically used in executing the control of train operation, so as to effectively ensure that when a train is the forefront train within its blocked section (interval), no following train would enter such interval at the same time and causes collision. The train signaling system is a common practice in realizing the "blockage." The block system that is most often applied by traditional railways is "Track Circuit Based Train Control, TBTC." With the current development of computer and communication technology, "Communication Based Train Control" has now emerged with advancement, allowing the operation of trains to possess higher reliability, flexibility and efficiency.

In reality, TBTC and CBTC exhibit a method or technique in realizing interval blockage. From the perspective of the form and effect of the blockage, fixed block system (FBS) and moving block system (MBS) are classified. The block interval of the fixed block system does not change, and the block interval must be greater than the length of the train. The block interval length of the moving blockage can be changed and be automatically adjusted according to the parameters of the train itself. It will move along with the train in motion and is a distance-to-go based control method. Moving blockage has a higher requirement than the fixed blockage; however, it possesses at the same time better operation efficiency. CBTC-MBS represents a relatively higher quality of modern train control.

While no matter it is TBCT, CBTC or FBS, MBS, the train and the ground are closely related to each other. Effective communication between the train and the ground must be enforced and through inspection of the ground facility or confirmation of the location of the train, effective train control signal can then be provided. Hence, effective "blockage" can be created and collision caused by the train entering into the block interval can be avoided. According to this methodology, TBCT and CBTC realized two different communication methods. The former is based on railway circuit to realize the connection between the train and the ground, the latter CBCT is based on wireless method to realize the communication between the train and the ground. Furthermore, when communicating between the train and the ground, the positioning of the track on the ground is realized. In order to realize the positioning function, track circuit, axle counter, transponder and cross-sensor cable etc. facilities must be paved on the train track to detect the train position and transmit the train position signal to the train control center (such as the CBTC). Lastly, the train control center produces the block interval and instructs or controls the train to operate within the interval. Such process is not only complicated, but is also relatively high in budget. Further, when the control center encounters breakdown, operation of the train must be terminated, or it can only apply manual operation method without signal protection. Under such condition, operational safety of the trains is not ensured, and when the signaling system breaks down and the manual operation causes error, disastrous train collision may happen.

The purpose of the embodiment of the present application is to provide an independent third kind of novel train signaling system without influence from the existing train operation system and train signaling system, which ensures a higher level of safety protection for train operation. At the same time, such system can also fully play the role of a train operator, and provide him explicit and exact position of the train in front, indications of the running train status and train speed, so that mental pressure of the operator can be relieved and "sudden death" train collision accidents can be prevented. At the same time, the embodiment in the present application can also provide safety protection for train operation under conditions such as existing signaling system break down, train positioning failure, track-entering error, and manual operation or instruction errors.

SUMMARY

According to one aspect, there is provided a train signaling system including a traffic signaling chain terminus set up unit configured to set a terminus location of a train running on the track and transmit a wireless traffic signal, a plurality of traffic signaling chain relay units installed along the track and configured to forward the wireless traffic signal and allow the wireless traffic signal to form a traffic signaling chain comprising distance-to-go information of the train, and a traffic signaling chain detection unit configured to allow the train to achieve the receipt of the information on the traffic signaling chain and calculate the distance-to-go of the train.

In one embodiment, the traffic signaling chain terminus set up unit may include at least one of the following units: (i) a stationary traffic signaling chain terminus set up unit, installed on a train station or road-side facility; and (ii) a moving traffic signaling chain terminus set up unit, installed on the train running on the track.

In one embodiment, each traffic signaling chain relay unit may include a track speed limiting set up unit configured to set a speed limitation on the train running on the track, and information on the speed limitation is provided within the wireless traffic signal of the traffic signaling chain. Each traffic signaling chain relay unit can be operable to communicate in both directions. Each traffic signaling chain relay unit may have a plurality of levels. The next level relay unit merely receives the wireless traffic signal transmitted by an upper level relay unit.

In one embodiment, each traffic signaling chain relay unit may include a train and obstruction detection unit configured to terminate the forwarding of wireless traffic signal of the traffic signaling chain when a train or an obstruction appearing within a specified area is detected, and a regenerating traffic signaling chain terminus set up unit configured to transmit a regenerated wireless traffic signal when the existence of wireless traffic signal transmitted by an upper level relay unit is not detected.

In one embodiment, each traffic signaling chain relay unit may include an ID set up unit configured to set a present level relay unit ID information and an upper level relay unit ID information; a relay spacing set up unit configured to set a spacing information between the present level relay unit and the upper or next level relay unit; and a signaling chain length accumulation unit configured to accumulate the spacing of each relay unit level by level.

In one embodiment, the traffic signaling chain may include a first wireless traffic signal and a second wireless traffic signal. Each traffic signaling chain relay unit may include a first wireless receiving device and a second wireless receiving device configured to receive the first wireless traffic signal and the second wireless traffic signal respectively, so as to form a first wireless traffic signaling chain and a second wireless traffic signaling chain.

In one embodiment, each traffic signaling chain relay unit may include a signaling chain length comparison unit configured to compare the length of the received first wireless traffic signaling chain and the second wireless traffic signaling chain, and the traffic signaling chain relay unit can select the wireless traffic signal of the signaling chain that is shorter in length for forwarding based on a comparison result.

In one embodiment, the traffic signaling chain detection unit may include a distance-to-go display unit configured to display a location or distance of a train or train station in front, a relative train speed display unit configured to display a relative speed of a train and the train in front, a hazard warning unit configured to provide different warnings according to different hazardous situations, and an automatic brake unit configured to brake the train in motion.

In one embodiment, the traffic signaling chain terminus set up unit can transmit the wireless traffic signal directing towards the track; and each traffic signaling chain relay unit can forward the wireless traffic signal directionally.

In one embodiment, each traffic signaling chain relay unit may include a train position synchronizing device configured to provide a position synchronizing signal for a passing train, allowing the passing train to be positioned at a definite location within the traffic signaling chain, and obtain the distance-to-go information of the passing train.

According to another aspect, there is provided a method for detecting the distance-to-go of a train, which may include the steps of transmitting a wireless traffic signal from a train station or train in front, forwarding the wireless traffic signal through a plurality of traffic signaling chain relay units installed along a track so as to form a traffic signaling chain, receiving the wireless traffic signal by a following train, and calculating the distance-to-go between the following train and the train station or train in front based on the wireless traffic signal received at the following train.

The method may further include the step of adding a spacing information between the traffic signaling chain relay unit and an upper level relay unit to the wireless traffic signal, when the traffic signaling chain relay unit forwards the wireless traffic signal.

The method may further include the step of terminating the forwarding of the wireless traffic signal automatically, when the traffic signaling chain relay unit detects existence of a train or an obstruction at a specified location.

The method may further include the steps of regenerating and transmitting a wireless traffic signal representing the traffic signaling chain with a length of zero, when the traffic signaling chain relay unit does not detect wireless traffic signal transmitted from the signaling chain terminus set up unit or an upper level relay unit. The wireless traffic signal can be used to set up a temporary traffic signaling chain terminus.

The method may further include the step of forwarding the wireless traffic signal with a shortest distance, if the traffic signaling chain relay unit detects two or more recognizable wireless traffic signals simultaneously.

In one embodiment, the step of transmitting the wireless traffic signal from the train station or train in front may include transmitting the wireless traffic signal directing towards the track from the train station or train in front, and the step of forwarding the wireless traffic signal through the traffic signaling chain relay units installed along the track may include forwarding the wireless traffic signal through the traffic signaling chain relay units installed along the track directionally.

The method may further include the steps of obtaining a position synchronizing signal from the traffic signaling chain relay unit, allowing a passing train to be positioned at a definite location within the traffic signaling chain, and obtaining a distance-to-go when the train passes the traffic signaling chain relay unit. The step of calculating the distance-to-go between the following train and the train station or train in front based on the wireless traffic signal received at the following train may include the step of calculating the distance-to-go between the following train and the train station or train in front based on the received train position synchronizing signal and the wireless traffic signal.

DETAILED DESCRIPTION

Figure 1:
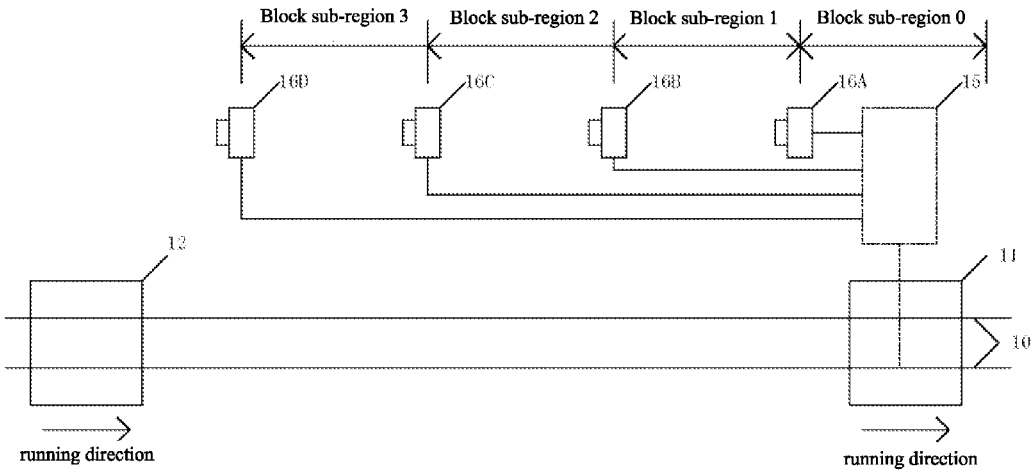
FIG. 1 is an illustrative diagram of a train signaling system based on track circuit in existing technology.

Below is a further description of the present application with reference to the drawings. Referring to FIG. 1, it is an illustrative diagram of a train signaling system based on track circuit in existing technology. In the Figure, reference numeral 10 represents a track, reference numeral 11 represents a train running in front on the track, and reference numeral 12 represents a following train running on the track following the train 11 in front. The running direction of the train 11 in front and the following train 12 is consistent.

Reference numeral 15 represents a signal device of the train signaling system. The signal device 15 detects the location of the trains through a track circuit. When train 11 in front enters the block sub-region 0, the signal device 15 will show a red color on several following signal lights after the train 11, such that the following train 12 can keep a safe distance from the train 11 in front. Specifically, the signal device 15 in FIG. 1 will show a red color on signal lights 16A, 16B (train should be stopped when seeing the red signal), show a yellow color on signal light 16C (train should be decelerated when seeing the yellow light) and show a green color on signal light 16D. The green color indicates that the train can be operated normally. Block sub-region 0 and block sub-region 1 are red light regions, block sub-region 2 is a yellow light region, and block sub-region 3 is a green light region, which correspond to a restriction region, a deceleration region and a safe region, respectively. While other signal lights after 16D should all be in green color, and when the following train is running within the green light region, it does not know the actual position of the train in front. If the signaling system breaks down (such as the red light is mistakenly shown as green light), then the hazard of collision with the train in front at any time may exist. This is a drawback of the traditional train track circuit signaling system.

Figure 2:
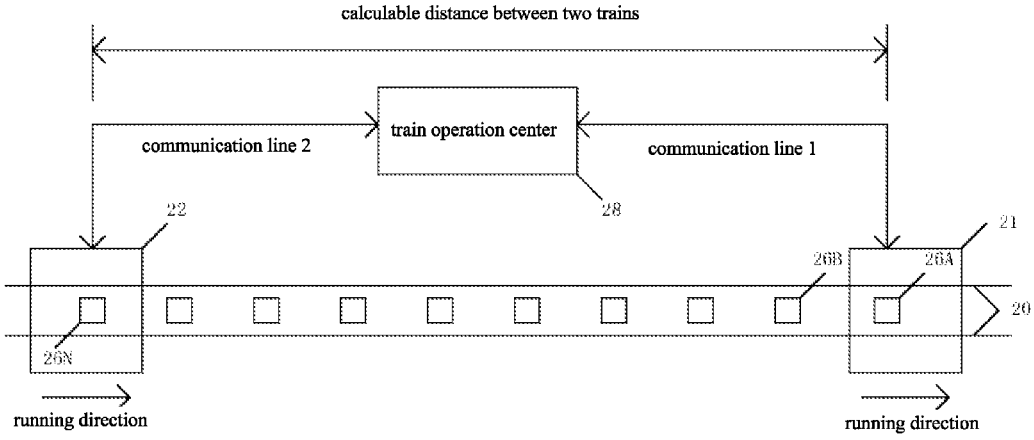
FIG. 2 is an illustrative diagram of a train signaling system based on communication in existing technology.

Referring to FIG. 2, it is an illustrative diagram of a train signaling system based on communication in existing technology. It represents a technology that is relatively advanced under the present train operation field and is an improvement to the system illustrated in FIG. 1. In FIG. 2, reference numeral 20 represents a track, reference numeral 21 represents a train running in front on the track, and reference numeral 22 represents a following train running on the track following the train 21 in front. The running direction of the train 21 in front and the following train 22 is consistent. The difference with the system in FIG. 1 lies in that the track in FIG. 2 includes a train positioning device (or called a train track occupying detection device, such as wireless transponder, crossover cable, etc., or called hereinbelow transponder or crossover cable in short) 26A, 26B to 26N (in the Figure, N transponders are represented, N>=1). When a running train passes by the transponder 26A, it will read the signal of 26A, so as to know that it is located at a position above 26A. The location signal will be transmitted to the train operation center 28 through a communication line 1 (usually wireless communication). Then the train operation center will then transmit the location signal of the train 21 in front to the following train 22 through communication line 2 (usually wireless communication), allowing the following train 22 to know the distance between it and the train 21 in front, so that safe operation of the train can be realized.

The train positioning accuracy shown in FIG. 2 is usually higher than the track circuit signaling system shown in FIG. 1. It is because the distribution density of the transponder is usually greater than the distribution density of the signal light. For example, one signal light is normally installed at every 1-3 kilometers, while the crossover cable can be set to crossover once at every 25 meters. The train positioning accuracy can reach 25 meters. Therefore, in comparing with the signaling system in FIG. 1, the system as shown in FIG. 2 possesses higher positioning control accuracy. Such can allow the spacing between running trains to be smaller, and the number of running trains to be greater. This means higher operation efficiency can be achieved. This kind of control system is especially suitable for railway transportation in a city (such as an underground railway system).

The key aspect of the system shown in FIG. 2 is the positioning and communication of trains. If the positioning of a train fails (such as when a transponder or sensor fails), then the train will have the hazard of "disappearing". Under such condition, the train of the whole region will need to be converted into visual based manual modes of operation, until the train is re-positioned or removed from the operating region in order to return to normal operation. Furthermore, if the communication between the train and the control center fails, then the situation is equivalent to that of failure in train positioning. The worst condition is that the train control center or the train controller gives a wrong position signal to the following train due to break down or human error, rendering the following train to collide with the train in front under a total unprepared condition. If such situation unfortunately happens, it will be a catastrophe.

Figure 3:
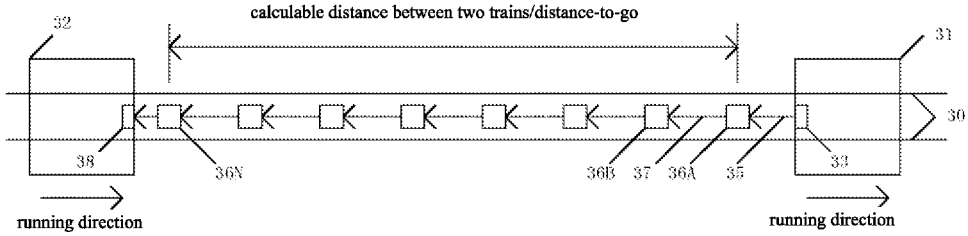
FIG. 3 is a first illustrative diagram of a dynamic train signaling system based on the length of a traffic signaling chain according to an embodiment of the present application.

Referring to FIG. 3, it is an illustrative diagram of a dynamic train signaling system based on the length of a traffic signaling chain according to an embodiment of the present application. In FIG. 3, reference numeral 30 represents a track, reference numeral 31 represents a train running in front on the track, and reference numeral 32 represents a following train running on the track following the train 31 in front. The running direction of the train 31 in front and the following train 32 is consistent. The system in FIG. 3 does not include the signal device and the signal light shown in FIG. 1, and does not include the communication line and train control center shown in FIG. 2. A wireless signal transmitter 33 may be installed at the rear end of the train 31 in front. A wireless signal receiver 38 may be installed at the front end of the following train 32. Wireless repeaters 36A, 36B to 36N may be installed along the track (the Figure includes N repearters, N>=1). Through this arrangement, wireless signal 35 can be sent out from the rear end of the train 31 in front. Through the signal chain formed from N repeaters, the last signal can be received by the following train 32 and the distance (spacing, namely length of the traffic signaling chain) between the train 31 in front and the following train 32 can be calculated through a specific calculation method performed at the following train 32.

According to the application function in an embodiment of the present application, the above signaling chain is called "traffic signaling chain". The length of the signaling chain represents the spacing between two trains. For the following train, it is the "distance-to-go" ahead of the track. In FIG. 3, the wireless signal transmitter 33 is called a "traffic signaling chain terminus set up unit", which represents the train terminus (train stopping point) of the following train. Since the train in front is a train in motion, the location of wireless signal transmitter 33 on the track moves in a forward direction along with the running train. As such, the wireless signal transmitter 33 can be called a "moving traffic signaling chain terminus set up unit", while those signals sent out can be called "wireless traffic signals". For the following train 32, the location of 36A is the terminus of the traffic signaling chain (or running train). The repeaters here can be called "traffic signaling chain relay units (also called relay units)". The wireless signal receiver 38 can be called a "traffic signaling chain detection unit". The traffic signaling chain detection unit includes the "traffic signaling chain length calculation unit", which performs the calculation of the spacing between the two trains.

In actual application, the spacing of the relay units is known. If the spacing is m, and the number of relay units between two trains is n, then the spacing between the two trains is m*n (m multiplies by n), and the gap between 36A and the wireless signal transmitter 33 (gap A) and gap between 36N and wireless signal receiver 38 (gap B). Since gaps A and B change along with the running train, they are difficult to calculate in reality. These two gaps are small relative to the spacing between two trains. Therefore, in reality they can be omitted without calculation and m*n can be taken directly as the spacing between the two trains (or called "distance-to-go" of the train).

In order to ensure that the transmission of the traffic signal can be proceeded in a step by step orderly manner, each relay unit will be assigned a unique ID (identity code), and can also be provided with an ID of the upper level relay unit and a spacing information of two relay units. This can effectively differentiate the signal of the upper level relay unit, and can add a self ID and the spacing information of two relay units when forwarding the wireless signal, so as to allow the next level relay unit to be able to receive, differentiate and calculate the signal chain length. For example, the repeater 36A can only receive the wireless signal 35 sent by the wireless signal transmitter 33, while the repeater 36B can only receive the wireless signal 37 sent by the repeater 36A. This can ensure the wireless signal sent by the wireless signal transmitter 33 can go through the N relay units orderly and be finally received by the wireless signal receiver 38. This can allow the entire length information of the traffic signaling chain to be obtained from the signal, while the length information represents the distance between the two trains (omitting the spacing A and spacing B).

Figure 4:
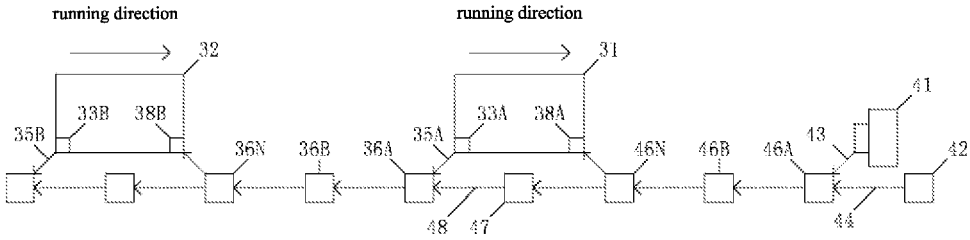
FIG. 4 is a second illustrative diagram of the dynamic train signaling system based on the length of the traffic signaling chain according to an embodiment of the present application.

Referring to FIG. 4, it is a second illustrative diagram of a dynamic train signaling system based on the length of the traffic signaling chain according to an embodiment of the present application. The difference with FIG. 3 lies in that FIG. 4 includes a train stopping signal device installed in the train station (or other stopping points). This train stopping signal device normally is shown as a red light signal, which is represented by reference numeral 41 in FIG. 4. The red light signal according to an embodiment of the present application is different from the red light in common railway. Besides the viewable red light signal, it can send out a wireless traffic signal 43. This signal is similar to the wireless traffic signal 35 in FIG. 3, and represents a starting point of a traffic signaling chain. For an approaching train, such red light represents the maximum distance-to-go. Therefore, the train stopping signal device 41 can be called a traffic signaling chain terminus set up unit. Since the train stopping signal device 41 is stationary and cannot be moved, it can be called a stationary traffic signaling chain terminus set up unit, in order to differentiate it from the movable moving signaling chain terminus set up unit 38 installed on the train.

In actual application, the signaling chain relay unit can encounter the situation of receiving two traffic signals simultaneously. For example, a relay unit 46A in FIG. 4 can receive at the same time wireless signal 43 sent by train stopping signal device 41 and wireless signal 44 sent by upper level relay unit 42. In order to effectively receive the two signals, two wireless signals which possess different nature, different frequencies or different acting positions can be considered for application, such as for example, infrared, microwave, ultrasonic wave, laser signals with different frequencies, or other viewable or non-viewable signals possessing directional characteristic.

When the relay unit 46A receives signals 43 and 44 simultaneously, the signaling chain length information in signals 43 and 44 will be compared and selected to forward the signal with a relatively shorter signaling chain. In FIG. 4, reference numeral 43 represents a train stopping signal in a train station, whose signaling chain length is usually set as zero (equivalent to train stopping point). Reference numeral 44 represents a signal forwarded from the upper level relay unit. The signal source can derive from the train or station further in front. Therefore, the length of the signaling chain of signal 44 is longer than that of signal 43. At this time, the repeater 36A will select to forward signal 43. For train 31, the relay unit 46A is an upcoming train stopping point.

The trains 31 and 32 both run on the track which covered by the traffic signaling chain. The traffic signaling chain detection units 38A and 38B installed at the front end of the train can both receive/detect the wireless signal of the traffic signaling chain, and can obtain the information of the distance-to-go ahead according to the condition of the detected signaling chain. The train 31 can travel up to location 46A and train 32 can travel up to location 36A and stop behind train 31. In reality, only if train 31 runs in a forward direction on the track, the wireless signal 35A representing the signaling chain terminus position will move continually in a forward direction. This can also allow the distance-to-go of train 32 ahead to continually extend in a forward direction. It will finally stop at the location of the relay unit 46A corresponding to the red light signal 41. Specifically, train 31 will first enter into station and stop before location 46A. After the train stopping time expires, a red light signal 41 will switch to a green light signal and the wireless signal 43 will disappear. Under such situation, the relay unit 46A will forward the traffic signal 44 from the upper level relay unit 42. This will cause the train 31 to start running and pass through the red light location 41, so as to reserve a space for train stopping in order to expect the arrival of train 32. This time, red light location 41 will again show a red light instructing train 32 to stop at the location of 46A, so as to realize the relevant control function of the train signaling system.

For the relay unit 36A in the Figure, similar situation as that of 46A will exist. It will at the same time receive wireless signal 48 from the upper level relay unit 47, and wireless signal of the moving signaling chain terminus set up unit 33A from the rear end of train 31. Under the condition in the Figure, signal 48 includes a signaling chain length which is much longer than that of the signal 35A (in the Figure, the signaling chain length of 35A can be taken as zero). This way, relay unit 36A will select to send signal 35A, representing 36A as the forthcoming terminus location for the running train 32 and preventing the train 32 to collide with the rear end of the train 31 in front.

Figure 5:
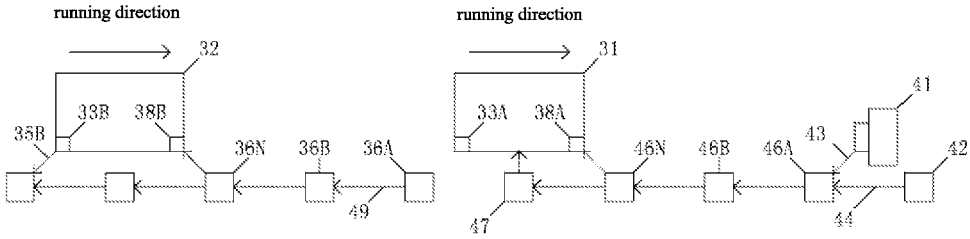
FIG. 5 is a third illustrative diagram of the dynamic train signaling system based on the length of the traffic signaling chain according to an embodiment of the present application.

Referring to FIG. 5, it is a third illustrative diagram of the dynamic train signaling system based on the length of the traffic signaling chain according to an embodiment of the present application. This is a special situation of the system shown in FIG. 4. The signaling chain relay unit according to an embodiment of the present application normally also possesses the function of train/obstruction detection, which can detect whether the space in front (and/or the forward and backward directions) has train or obstruction. If objects are found to exist, the forwarding of signal of the upper level relay unit will be purposely terminated. This function can further increase the security and reliability level of the system, and prevent the next level relay unit to forward the erroneous traffic signal. That is, under the condition of FIG. 4, relay unit 36A can only forward signal 35A and does not erroneously forward signal 48. Since signal 48 under the condition in FIG. 5 would not exist, the situation of wrongful selection will not happen.

Another significance of the relay unit to stop the traffic signal forwarding function under the existence of train or obstruction is to prevent the following train to receive the erroneous signal because of breaking down of the moving signaling chain terminus set up unit. In FIG. 5, assuming the moving signaling chain terminus set up unit 33A at the rear end of train 31 breaks down and cannot transmit wireless traffic signal 35A with signaling chain length as zero. The relay unit 36A at the next level cannot receive any recognizable wireless traffic signal (36A only receives signal 35A and signal 48). Since the existence of the traffic signaling chain cannot be detected, the relay unit 36A will automatically regenerate a new traffic signal 49 with a signaling chain length as zero, which represents a terminus location of the signaling chain. Under such condition, the relay unit can be called as "regenerating traffic signaling chain terminus set up unit," or it includes "regenerating traffic signaling chain terminus set up unit." In the absence of the above train/obstruction detection function, and the signal terminus function and traffic signaling chain regenerating function during times of train/obstruction existence, after the moving signaling chain terminus set up unit 33A at the rear end of the train breaks down, the train 31 will become "disappeared." As such, the hazard of the following train 32 colliding with the train in front 31 will exist. The above function can effectively resolve such hazard.

Figure 6:
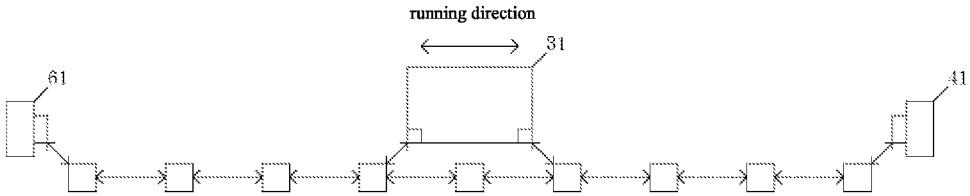
FIG. 6 is a fourth illustrative diagram of the dynamic train signaling system based on the length of the traffic signaling chain according to an embodiment of the present application.

Referring to FIG. 6, it is a fourth illustrative diagram of the dynamic train signaling system based on the length of the traffic signaling chain according to an embodiment of the present application. The traffic signaling chain relay unit as illustrated possesses bi-directional communication capability. Relevant traffic signal can be transmitted to train 31 from station 41 (train stopping signal device), and can also be transmitted to train 31 from station 61 (train stopping signal device). Therefore, train 31 can receive the signal of the traffic signaling chain when running in any one direction, and is protected by the signal of the traffic signaling chain. When train 31 on the track does not exist (that is, the interval from 41 to 61 has no train), the traffic signal can be transmitted to 61 from 41, and be transmitted to 41 from 61. Such function can be applied on self examination of the signal system, and can ensure all the relay units and terminus set up units within the entire interval can operate normally.

Figure 7:
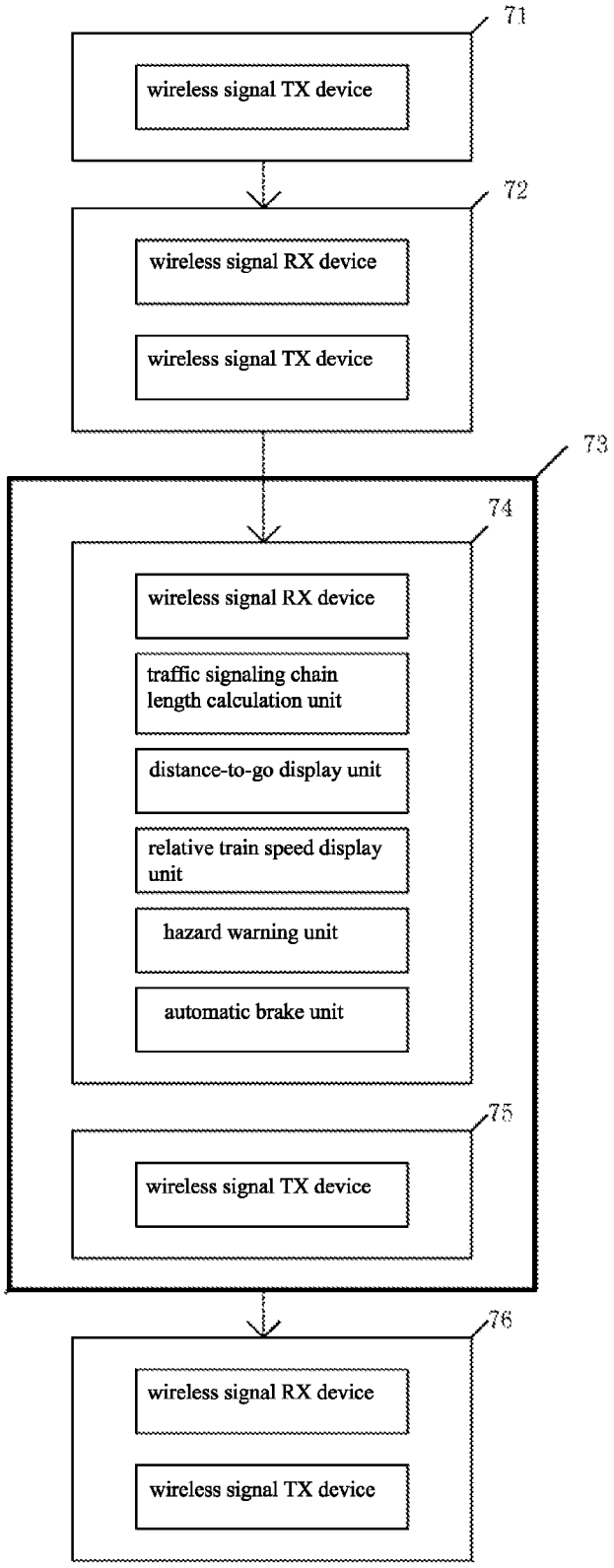
FIG. 7 is a first block diagram of the dynamic train signaling system based on the length of the traffic signaling chain according to an embodiment of the present application.

Referring to FIG. 7, it is a first block diagram of the dynamic train signaling system based on the length of the traffic signaling chain according to an embodiment of the present application. In the Figure, reference numeral 71 represents a stationary traffic signaling chain terminus set up unit (train stopping signal device on the station) or a moving traffic signaling chain terminus set up unit (the signal device installed at the rear end of the train). It includes a wireless signal transmitting (TX) device, which can transmit wireless traffic signal of the traffic signaling chain with length as zero, for providing a terminus location for the running train. The reference numeral 71 can also be an upper level traffic signaling chain relay unit, in which wireless signal transmitting device transmits wireless traffic signal that includes a length information of the traffic signaling chain before the unit 71. Reference numeral 72 represents a traffic signaling chain relay unit, including a wireless signal receiving (RX) device and a wireless signal transmitting device. It can forward wireless traffic signal from traffic signaling chain terminus set up unit or upper level relay unit, and form a traffic signaling chain. The signal of the signaling chain can be detected and received by the traffic signaling chain detection unit 74 that can be installed at the front end of train 73 and can calculate the distance of a train from the train stopping location or from the train in front based on the internal traffic signaling chain length calculation unit.

The traffic signaling chain detection unit 74 may also include a distance-to-go display unit, which can be installed inside the operation compartment to display for the train operator the location or distance of the train or stopping station in front. The traffic signaling chain detection unit 74 may also include a relative train speed display unit, which can display the speed of the train relative to that of the train in front. If there is no train in front and only has a stopping station, the displayed speed signal represents the running speed of the train. The traffic signaling chain detection unit 74 may also include a hazard warning unit and an automatic brake unit. The hazard warning unit will issue different kinds of warnings according to different hazardous situations. The hazardous situation can be assessed based on the speed of the train, the relative speed between the two trains, the distance between the two trains and the parameters of the braking of the train. If the hazard level further rises, the traffic signaling chain detection unit 74 can initiate the automatic brake unit, so as to prevent train collision from occurring due to human negligence. The train 73 may also include a moving traffic signaling chain terminus set up unit 75 installed at the rear end of the train. The moving traffic signaling chain terminus set up unit 75 may include a wireless signal transmitting device, which can transmit wireless traffic signal of the traffic signaling chain with length as zero, for providing the terminus location for the following train. The wireless signal can be received by another traffic signaling chain relay unit 76 on the track, and the relevant traffic signal can be further forwarded to the following one, so as to form a traffic signaling chain encompassing the whole running interval.

Figure 8:
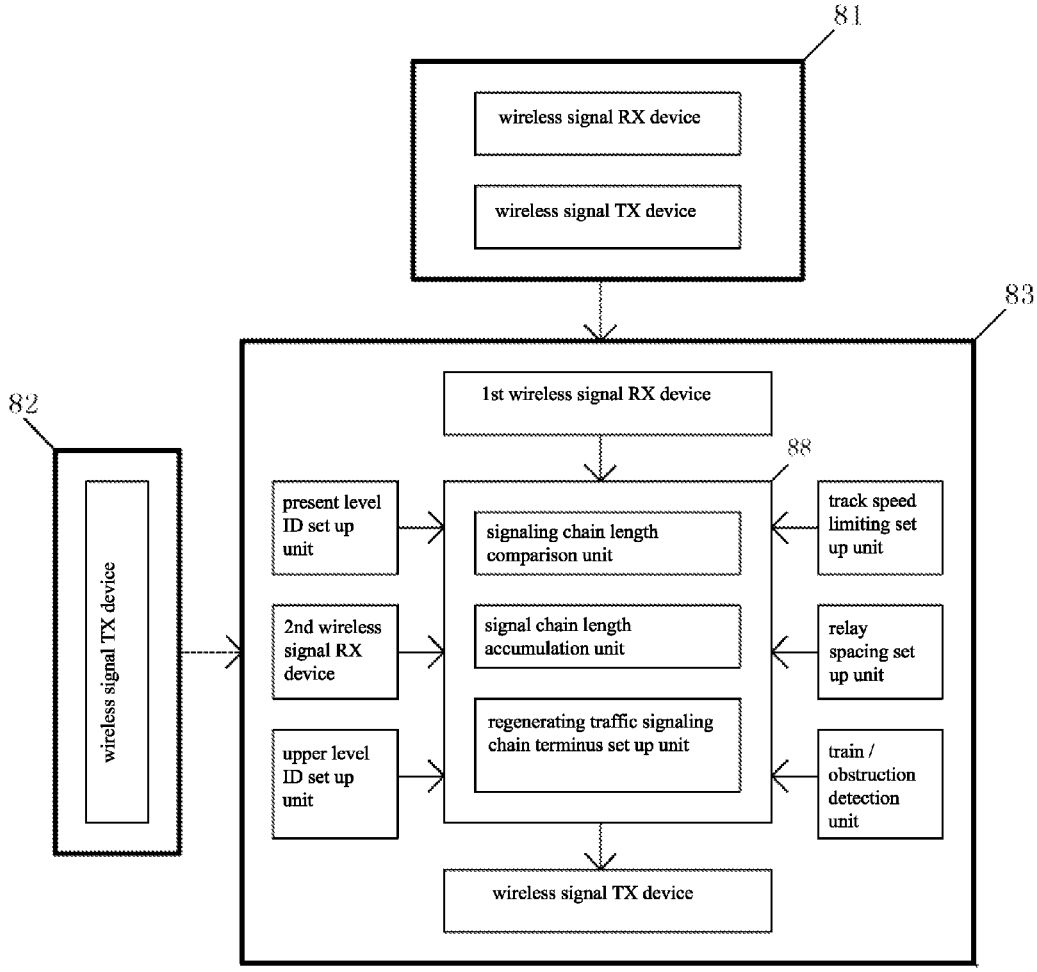
FIG. 8 is a second block diagram of the dynamic train signaling system based on the length of the traffic signaling chain according to an embodiment of the present application.

Referring to FIG. 8, it is a second block diagram of the dynamic train signaling system based on the length of the traffic signaling chain according to an embodiment of the present application. In the Figure, reference numeral 81 represents one of the traffic signaling chain relay units on the track, which may include a wireless signal receiving device and a wireless signal transmitting device, and can forward the wireless traffic signal (the first wireless traffic signal) of an upper level signaling chain relay unit. Reference numeral 82 represents a traffic signaling chain terminus set up unit (including stationary and moving traffic signaling chain terminus set up unit). It may include a wireless signal transmitting device, which can transmit wireless traffic signal of the traffic signaling chain with length as zero (the second wireless traffic signal). The first and the second wireless traffic signals can be received by the first wireless receiving device and the second wireless receiving device, respectively, of another traffic signaling chain relay unit 83. The signal received will be transmitted to a signal processing unit 88 (micro processor or micro controller etc.) within the relay unit 83 for processing. Self ID information and upper level relay unit ID information can be set by the present level ID (identification code) set up unit and the upper level ID set up unit that can be connected to the signal processing unit 88, so as to determine the validity of the signal received. Further, the relay interval set up unit can set the interval of the present relay unit and the upper level relay unit.

The signal processing unit 88 may include a signaling chain length comparison unit, which can compare the length of the first traffic signaling chain and the second traffic signaling chain from the first wireless receiving device and the second wireless receiving device, respectively, and select the signal with a relatively shorter signaling chain for forwarding. In FIG. 8, the second wireless receiving device receives the second wireless signal with the shortest signal chain length (i.e. zero), which is transmitted from the traffic signaling chain terminus set up unit 82. Therefore, the relay unit 83 will forward the wireless traffic signal from the traffic signaling chain terminus set up unit 82 through its internal wireless signal transmitting device, and set the length of the traffic signaling chain as zero.

Assuming the signal transmitted from the traffic signaling chain terminus set up unit 82 disappears (such as the stopping station signal changes from red to green), at this moment the relay unit 83 receives the first wireless traffic signal transmitted from relay unit 81 only through the first wireless receiving device. This signal may include the traffic signaling chain length information and ID information of the relay unit 81 which are accumulated from the upper level relay unit. When the ID information of the relay unit 81 is confirmed by the relay unit 83, the relay unit 83 will, through the signal chain length accumulation unit of the signal processing unit 88, add the spacing information of the relay units 83 and 81 included in the relay spacing set up unit to the traffic signaling chain length information received, and convert the ID formation of the relay unit 81 in the traffic signal into the ID information of the relay unit 83. Then, the relay unit located at the next level of the relay unit 83 will receive such wireless signal, and undergo signal processing similar to the preceding relay unit 83, rendering the length of the signaling chain to be accumulated until it meets the next traffic signaling chain terminus set up unit.

The relay unit 83 may also include a train/obstruction detection unit, which can detect train/obstruction at the upper, upfront and rear end direction of the relay unit. When train/obstruction exists, the signal processing unit 88 will automatically terminate the forwarding function of the wireless traffic signal. This is described with reference to FIG. 5. When the first and second wireless receiving devices of the relay unit 83 have not received any recognizable wireless traffic signal, they will automatically activate the regenerating traffic signaling chain terminus set up unit of the signal processing unit 88. This regenerating traffic signaling chain terminus set up unit will reset the length information of the traffic signaling chain as zero, and take the relay unit 83 as the terminus point of the running train, so as to prevent the running train from exceeding the relay unit 83 and entering into uncertain area and causing collision. This is an effective "malfunction—safety" working method.

Further, the relay unit 83 also has a track speed limiting set up unit, which can set a speed limitation of the train that runs on the track. The speed limiting information may be included in the wireless traffic signal of the traffic signaling chain. When the train receives the wireless traffic signal, it can obtain relevant information on speed limiting from the signal and provide a real-time speed indication or over speeding warning for safe operation of the train so as to further ensure the safety of the train that is running on the track. Furthermore, the relay unit 83 can also include other relevant information of the track, such as information on the slope of the track. These parameters have a large effect on the braking of the train. Accurate information about the slope can assist in the analysis of the hazard level with regard to the train, so that the most suitable safety distance of the running train relative to the train in front can be maintained.

Figure 9:
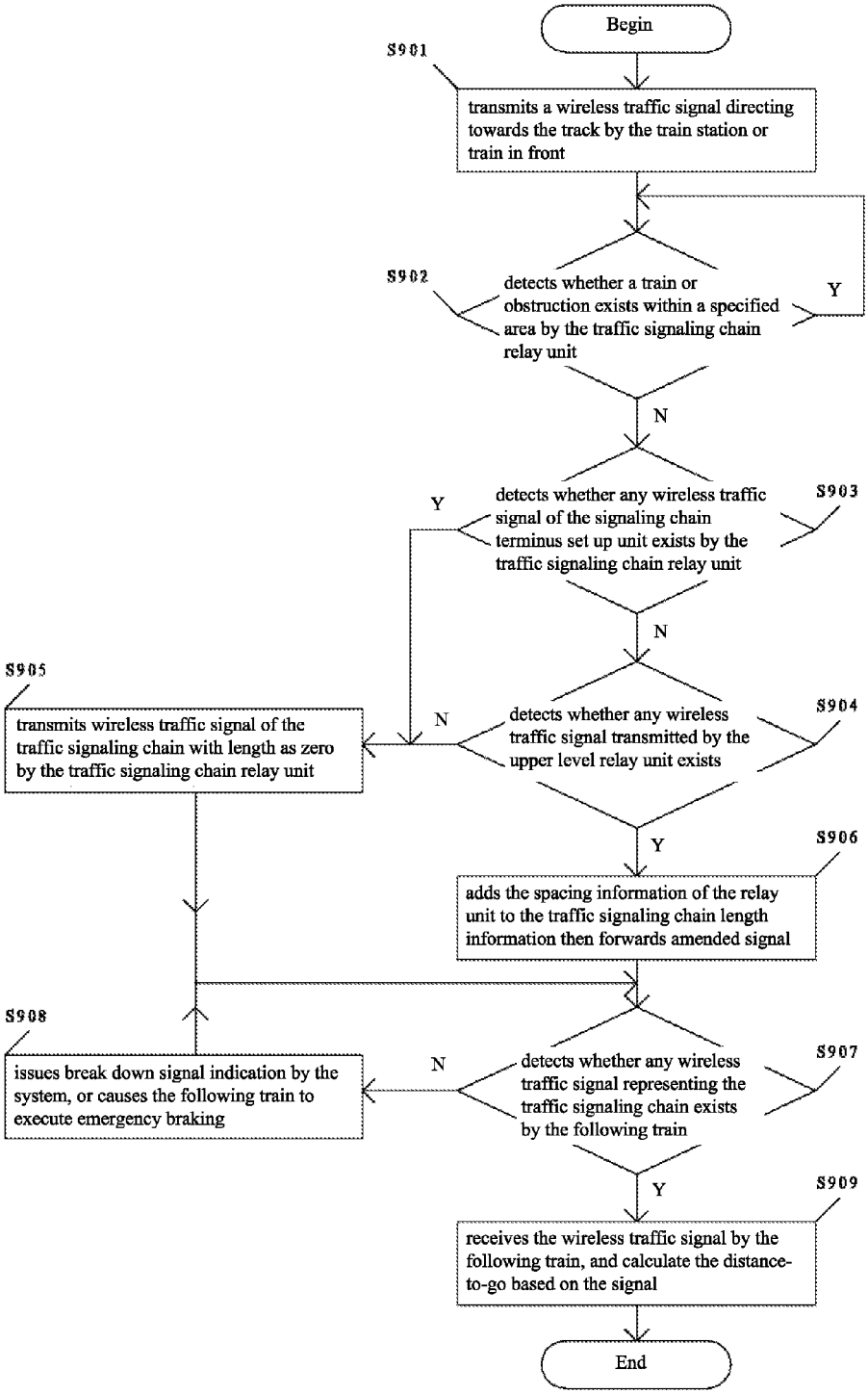
FIG. 9 is a flow chart of a method for detecting the distance-to-go of a train based on the length of the traffic signaling chain according to an embodiment of the present application.

Referring to FIG. 9, it is a flow chart of a method for detecting the distance-to-go of a train based on the length of traffic signaling chain according to an embodiment of the present application. The method may include the following steps:

Step S901 transmits a wireless traffic signal directing towards the track by the train station or train in front, for setting the terminus location of the traffic signaling chain before entering into step S902.

Step S902 detects whether a train or obstruction exists within a specified area by the traffic signaling chain relay unit. If so, then the signal forwarding function of the relay unit will be terminated and the step S902 will be repeated until no train or obstruction exists, then will enter into step S903.

Step S903 detects whether any wireless traffic signal of the signaling chain terminus set up unit exists by the traffic signaling chain relay unit. If so, then enter into step S905. If not, then enter into step S904.

Step S904 detects whether any wireless traffic signal transmitted by the upper level relay unit exists. If so, then enter into step S906. If not, then enter into step S905.

Step S905 transmits wireless traffic signal of the traffic signaling chain with length as zero by the traffic signaling chain relay unit, for setting the terminus location of the traffic signaling chain, and then enter into step S907.

Step S906 adds the spacing information of the relay unit to the traffic signaling chain length information by the traffic signaling chain relay unit, then forwards the amended traffic signal before entering into step S907.

Step S907 detects whether any wireless traffic signal representing the traffic signaling chain exists by the following train. If so, then enter into step S909. If not, then enter into step S908.

Step S908 issues break down signal indication by the system, or causes the following train to execute emergency braking before returning to step S907.

Step S909 receives the wireless traffic signal by the following train, and calculate the distance-to-go between the following train and the train station or train in front based on the signal.

The above steps S901-S909 are continuously ongoing so as to ensure the following train can obtain real-time distance-to-go data on a continuous ongoing basis. These data serves to provide indications for the train operator, so as to allow the operator to know the status of the train station or train in front in a timely manner. Furthermore, through continuous detection of the distance-to-go, the relative speed of the two trains can be calculated and the minimum safety distance that must be maintained between the two trains can be calculated. If the safety distance is found to be insufficient, then safety warning or emergency alarming can be executed. Under emergency situation, the train can be directly stopped so as to ensure the safety in the operation of the train.

In FIGS. 3-9, the wireless traffic signal according to an embodiment of the present application is directional. The traffic signaling chain terminus set up unit and the traffic signaling chain relay unit transmit wireless traffic signal directing towards the track under normal condition. These signals can be infrared, microwave, ultrasound wave, or laser. Since these signals are directional, the effect of other signals on neighboring tracks can be prevented. At the same time, the effect of traffic signal from the opposite direction can be prevented. However, signals that are directional still have other deficiency, that is, they can easily be influenced by the weather (such as during blizzards). Further, the transmitting and receiving of the traffic signaling chain on a curved path of a track are not quite satisfactory (such as the existence of situation of receiving signal at a blind spot).

Figure 10:
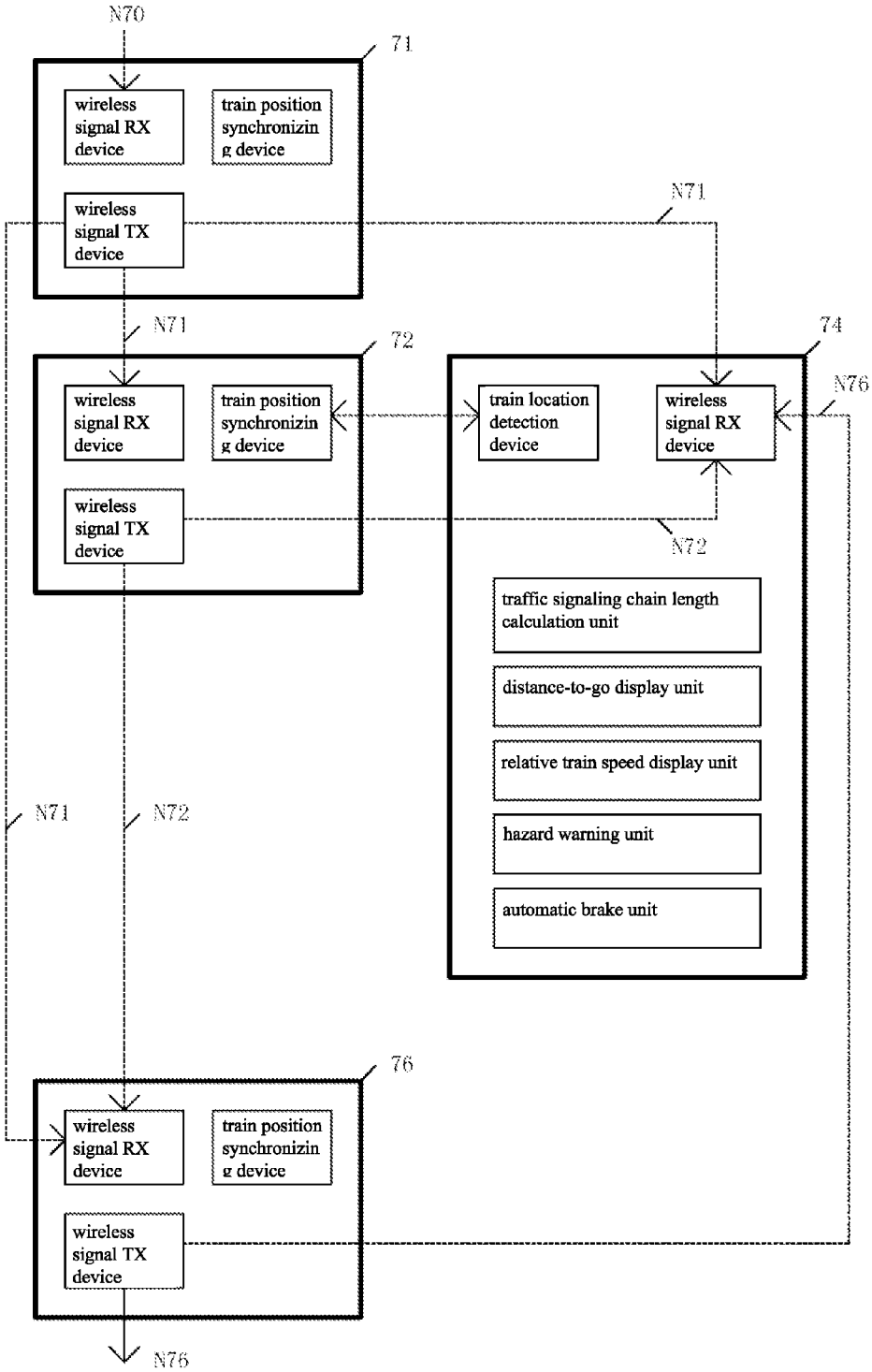
FIG. 10 is a diagram of the dynamic train signaling system based on the length of the traffic signaling chain according to an embodiment of the present application.

In order to fulfill the technical demand for actual application at different situations, the embodiment of the present application can also apply direction-absent signals (such as the common wireless RF signal) as the traffic signals. Referring to FIG. 10, it is a diagram of a dynamic train signaling system based on the length of the traffic signaling chain according to an embodiment of the present application. It is a supplement and development of the embodiments in FIGS. 7-9. In FIG. 10, reference numeral 71 represents an upper level traffic signaling chain relay unit. The wireless signal transmitting device transmits wireless traffic signal which may include length information of the traffic signaling chain before the upper level traffic signaling chain relay unit 71. Reference numeral 72 represents an immediate traffic signaling chain relay unit, which may include a wireless signal receiving device and a wireless signal transmitting device, and can receive a wireless traffic signal N71 that includes the ID information of the upper level relay unit 71. Then, on the basis of wireless traffic signal N71 the length of the traffic signaling chain can be amended (adding a distance between 71-72). Further, the ID information of the immediate traffic signaling chain relay unit 72 and other relevant information can be added. It is then forwarded to form a new wireless traffic signal N72. Similarly, the wireless traffic signal N72 is received by the relay unit 76 of the next level, and upon processing; it is forwarded as a new traffic signal N76 so as to form a complete traffic signaling chain.

Since the wireless traffic signal of the system in FIG. 10 is not directional, the strength and coverage scope of the signal transmitted must be taken into concern. The optimal situation is when the signal is only received by the neighboring relay unit (or by the train operating within the interval). However, during actual application, the situation of signal overlapping may likely occur, that is, one relay unit (or a train operating on the track) can receive several wireless signals simultaneously. For example, FIG. 10 illustrates the relay unit 76 that can receive two signals N71 and N72 simultaneously. While the traffic signaling chain detection unit 74 on the train receives the signal N72, it can also receive two signals N71 and N76. Under such situation, how does the relay unit select the correct signal for forwarding and how does the train running on the track confirm the position of its own traffic signaling chain, and obtain from there the correct distance-to-go information?

For the relay unit, since it includes its ID information and the upper level relay unit ID information (see FIG. 8) simultaneously, the relay unit can easily find out which signal is effective. For example, it can only receive the traffic signal sent out by the upper level relay unit and ignore the other signals. For the train running on the track, its location can be determined according to the strength of the traffic signal received. For example, in FIG. 10, the train is closest to the relay unit 72; conceptually the strength of the signal of N72 is highest. The train can position itself on the relay unit 72 based on this condition. Further, the train can select the signal with the shortest distance among the traffic signals received to perform positioning. For example, the distance-to-go of the signal N71 in FIG. 10 is the shortest, and therefore, the train can be positioned at the relay unit 71. The beneficial characteristic of this method is that it allows the train to possess the largest safety coefficient. Besides, it can allow the train and the relay units on the track to perform positioning synchronization, so as to obtain a more reliable positioning signal. In order to realize such function, the relay unit in FIG. 10 is provided with a train position synchronizing device. Such device can exchange signal with the passing by train (provide ID information), so as to provide the passing by train a reliable positioning. At the same time, the train can also be provided with a train location detection device. When the train passes by the relay unit 72, the ID information of the relay unit 72 can be obtained. The train compares this ID information with the ID information included in the received traffic signals N71, N72 and N76, and then can find out which traffic signal is effective (N72 in FIG. 10 is an effective signal). It can retrieve the distance-to-go information of the train in front from the effective traffic signal. That is, through obtaining the position synchronizing signal, the passing by train can itself be positioned at the exact location within the traffic signaling chain. For example, when the train in front receives the position synchronizing signal, and detects from there the ID information of the relay unit 72, and it can be aware that it is running within the location of the relay unit 72. At this time, even if the train receives the traffic signals N71, N72 and N76, but according to its own location, N72 belongs to effective traffic signals, and N71 and N76 belongs to interfering signals. From this, the train can effectively find out the distance-to-go of the train according to the traffic signal N72 without interference. Other functional modules of the traffic signaling chain detection unit 74 in FIG. 10 and the functional modules in FIG. 8 are similar and will not be reiterated.

The train position synchronizing device and the train position detection device can have many realization solutions, such as the train position synchronizing device can be a wireless transmitting device that is short distance or directional such as infrared, microwave, DSRC, ultrasound wave transmitting device etc, and can transmit wireless signal including its ID signal. Further, they can also apply RFID technology to realize the information exchange/position synchronization of the train and the relay unit. For the train position synchronizing, it can be unidirectional (can use the unidirectional wireless transmitter to transmit the ID signal of the relay unit to the train), and can also be bidirectional (such as using DSRC, RFID as such technique to perform information exchange). A beneficial aspect of a bidirectional information exchange is that the relay unit can find out the existence of a train through information exchange. Accordingly signal regarding train track in usage can be sent out, or the transmitting of wireless traffic signal can be terminated, which can allow the next level relay unit to automatically transmit regenerating wireless traffic signal that represents traffic signaling chain with length as zero. This can realize the automatic track blocking function. Such function has been described in the description of FIG. 5.

According to the FIGS. 3-10, one can further summarize/refine the method for detecting the distance-to-go of a train, which may include the following steps:

Wireless traffic signal is transmitted from the train station or train in front (through traffic signaling chain terminus set up unit), or wireless traffic signal is transmitted directionally towards the track;

Wireless traffic signal can be forwarded (or wireless traffic signal is directionally forwarded) by the traffic signaling chain relay units configured along the track, so as to form a traffic signaling chain. The wireless traffic signal is received by the following train;

When the following train passes by the traffic signaling chain relay unit, train position synchronizing is undergone (for the direction-absent wireless traffic signaling chain system);

Based on the wireless traffic signal (or aggregate train positioning synchronizing signal) as received by the following train to calculate the distance-to-go between the following train and the train station or train in front;

When the traffic signaling chain relay unit forwards the wireless traffic signal, a spacing information of the upper level relay unit is added to the wireless traffic signal;

The traffic signaling chain relay unit terminates the forwarding of wireless traffic signal when train or obstruction is detected to exist within a specified area;

When the traffic signaling chain relay unit cannot detect the wireless traffic signal sent by the signaling chain terminus set up unit or the upper level relay unit, it will regenerate and send out a new wireless traffic signal that represents traffic signaling chain with length as zero. The signal can be used to set up a temporary traffic signaling chain terminus; and If the traffic signaling chain relay unit detects at the same time two or more recognizable wireless traffic signals, the wireless traffic signal with the shortest distance will only be forwarded.

The beneficial result that the present application possesses lies in that it is a brand new dynamic train signaling system and the method for detecting the distance-to-go of a train based on the length of traffic signaling chain, whose operation does not rely on track circuit, axle counter, transponder, cross-sensor cable as such tracking or road-side facilities, and also does not rely on signals of the existing train signaling system and train control center. There are beneficial fulfillment and secured coverage towards the existing train operating system.

The above device and method mentioned are merely partial preferred embodiments of the present application. For those skilled in the art, it should be noted, and without departing from the original concepts of the present application, further amendment and refinement can be made and would be treated as belonging within the scope of protection of the present application.

What is claimed is:

1. A train signaling system comprising:

a traffic signaling chain terminus set up unit configured to set a terminus location of a train running on the track and transmit a wireless traffic signal;

a plurality of traffic signaling chain relay units installed along the track and configured to forward the wireless traffic signal and allow the wireless traffic signal to form a traffic signaling chain comprising distance-to-go information of the train; and a traffic signaling chain detection unit configured to allow the train to achieve the receipt of the information on the traffic signaling chain and calculate the distance-to-go of the train;

wherein each traffic signaling chain relay unit has a plurality of levels; and each traffic signaling chain relay unit comprises:

an ID set up unit configured to set a present level relay unit ID information and an upper level relay unit ID information;

a relay spacing set up unit configured to set a spacing information between the present level relay unit and the upper or next level relay unit; and a signaling chain length accumulation unit configured to accumulate the spacing of each relay unit level by level.

2. The train signaling system according to claim 1, wherein the traffic signaling chain terminus set up unit comprises at least one of the following units:

a stationary traffic signaling chain terminus set up unit, installed on a train station or road-side facility; and a moving traffic signaling chain terminus set up unit, installed on the train running on the track.

3. The train signaling system according to claim 1, wherein each traffic signaling chain relay unit comprises:

a track speed limiting set up unit configured to set a speed limitation on the train running on the track, and information on the speed limitation is provided within the wireless traffic signal of the traffic signaling chain.

4. The train signaling system according to claim 1, wherein each traffic signaling chain relay unit is operable to communicate in both directions.

5. The train signaling system according to claim 1, wherein a next level relay unit merely receives the wireless traffic signal transmitted by an upper level relay unit.

6. The train signaling system according to claim 1, wherein each traffic signaling chain relay unit comprises:

a train and obstruction detection unit configured to terminate the forwarding of wireless traffic signal of the traffic signaling chain when a train or an obstruction appearing within a specified area is detected; and a regenerating traffic signaling chain terminus set up unit configured to transmit a regenerated wireless traffic signal when the existence of wireless traffic signal transmitted by an upper level relay unit is not detected.

7. The train signaling system according to claim 1, wherein the traffic signaling chain comprises a first wireless traffic signal and a second wireless traffic signal;

each traffic signaling chain relay unit comprises a first wireless receiving device and a second wireless receiving device configured to receive the first wireless traffic signal and the second wireless traffic signal respectively, so as to form a first wireless traffic signaling chain and a second wireless traffic signaling chain.

8. The train signaling system according to claim 7, wherein each traffic signaling chain relay unit comprises a signaling chain length comparison unit configured to compare the length of the received first wireless traffic signaling chain and the second wireless traffic signaling chain; and wherein the traffic signaling chain relay unit selects the wireless traffic signal of the signaling chain that is shorter in length for forwarding based on a comparison result.

9. The train signaling system according to claim 1, wherein the traffic signaling chain detection unit comprises:

a distance-to-go display unit configured to display a location or distance of a train or train station in front;

a relative train speed display unit configured to display a relative speed of a train and the train in front;

a hazard warning unit configured to provide different warnings according to different hazardous situations; and an automatic brake unit configured to brake the train in motion.

10. The train signaling system according to claim 1, wherein the traffic signaling chain terminus set up unit transmits the wireless traffic signal directing towards the track; and each traffic signaling chain relay unit forwards the wireless traffic signal directionally.

11. The train signaling system according to claim 1, wherein each traffic signaling chain relay unit comprises a train position synchronizing device configured to provide a position synchronizing signal for a passing train, allowing the passing train to be positioned at a definite location within the traffic signaling chain, and obtain the distance-to-go information of the passing train.

12. A method for detecting the distance-to-go of a train, the method comprising the steps of:

transmitting a wireless traffic signal from a train station or train in front;

forwarding the wireless traffic signal through a plurality of traffic signaling chain relay units installed along a track so as to form a traffic signaling chain;

receiving the wireless traffic signal by a following train; and calculating the distance-to-go between the following train and the train station or train in front based on the wireless traffic signal received at the following train;

further comprising the step of:

adding a spacing information between the traffic signaling chain relay unit and an upper level relay unit to the wireless traffic signal, when the traffic signaling chain relay unit forwards the wireless traffic signal.

13. The method according to claim 12, further comprising the step of:

terminating the forwarding of the wireless traffic signal automatically, when the traffic signaling chain relay unit detects existence of a train or an obstruction at a specified location.

14. The method according to claim 12, further comprising the steps of:

regenerating and transmitting a wireless traffic signal representing the traffic signaling chain with a length of zero, when the traffic signaling chain relay unit does not detect wireless traffic signal transmitted from the signaling chain terminus set up unit or an upper level relay unit, the wireless traffic signal is used to set up a temporary traffic signaling chain terminus.

15. The method according to claim 12, further comprising the step of:

forwarding the wireless traffic signal with a shortest distance, if the traffic signaling chain relay unit detects two or more recognizable wireless traffic signals simultaneously.

16. The method according to claim 12, wherein the step of transmitting the wireless traffic signal from the train station or train in front comprises transmitting the wireless traffic signal directing towards the track from the train station or train in front; and the step of forwarding the wireless traffic signal through the traffic signaling chain relay units installed along the track comprises forwarding the wireless traffic signal through the traffic signaling chain relay units installed along the track directionally.

17. The method according to claim 12, further comprising the steps of obtaining a position synchronizing signal from the traffic signaling chain relay unit, allowing a passing train to be positioned at a definite location within the traffic signaling chain, and obtaining a distance-to-go when the train passes the traffic signaling chain relay unit; and wherein the step of calculating the distance-to-go between the following train and the train station or train in front based on the wireless traffic signal received at the following train comprises the step of calculating the distance-to-go between the following train and the train station or train in front based on the received train position synchronizing signal and the wireless traffic signal.

* * * * *